US005119961A

United States Patent [19]

Runn

[11] Patent Number: 5,119,961

[45] Date of Patent: Jun. 9, 1992

[54] ELECTRIC PICKUP WINCH

[76] Inventor: Lawrence E. Runn, 513 Arizona, Lawrence, Kans. 66049

[21] Appl. No.: 463,498

[22] Filed: Apr. 9, 1990

[51] Int. Cl.[5] ..... B66C 23/36

[52] U.S. Cl. ..... 212/180; 212/230; 414/563

[58] Field of Search ..... 212/179, 180, 182, 186, 212/224, 230, 231, 244, 254, 264, 265, 267, 181; 414/486, 546, 560-563, 592, 607, 629, 541, 542

[56] References Cited

U.S. PATENT DOCUMENTS

| | | | |
|---|---|---|---|
| 1,402,074 | 1/1922 | Kloehn | 414/563 |
| 1,559,880 | 11/1925 | Lonides | 212/180 |
| 1,560,071 | 11/1925 | Baker | 414/563 |
| 1,641,351 | 9/1927 | Nilson | 414/563 |
| 1,699,587 | 1/1929 | Grenier | 212/230 |
| 2,290,384 | 7/1942 | Rowe | 414/541 |
| 2,392,986 | 1/1946 | Helle | 212/265 |
| 2,509,435 | 5/1950 | Huttinger | 414/563 |
| 2,568,959 | 9/1951 | Illies | 212/180 |
| 2,978,115 | 4/1961 | Prestel | 212/197 |
| 3,301,416 | 1/1967 | Bopp | 212/231 |
| 3,306,467 | 2/1967 | Weempe | 414/541 |
| 3,638,804 | 2/1972 | Blakeway et al. | 212/244 |
| 3,788,492 | 1/1974 | Kraft | 212/267 |
| 3,888,368 | 6/1975 | Hawkins | 414/563 |
| 4,216,941 | 8/1980 | Little | 212/265 |
| 4,383,792 | 5/1983 | Seabloom et al. | 414/563 |
| 4,463,858 | 8/1984 | Bilas | 212/265 |

FOREIGN PATENT DOCUMENTS

| | | | |
|---|---|---|---|
| 918256 | 4/1982 | U.S.S.R. | 212/244 |

OTHER PUBLICATIONS

Electric Crones-Pacific Series 66, Pacific Hoist, Portland Oregon—(4 pages).

*Primary Examiner*—Sherman Basinger
*Assistant Examiner*—Thomas J. Brahan

[57] ABSTRACT

A removable, truck mounted crane with both an inclined boom for high lift and a horizontal telescoping boom for extended reach beyond the truck. The crane has two winches either of which can be routed to either boom. The high boom can be used normally for hoisting or to support the horizontal boom when extended. In addition, one winch can be used to retract the horizontal boom while under load. A rolling storage stand with winches is used to support the truck tailgate while enabling one person to install or remove the crane from the truck.

2 Claims, 4 Drawing Sheets

ELECTRIC PICKUP WINCH

BACKGROUND OF THE INVENTION

1) Field of the Invention

This invention generally relates to a light crane attachment which is desigend to be temporarily mounted onto the bed of a pick-up truck, and to the method of installation, removal, and storage of the crane when it is off the truck.

2) Description of the Prior Art

Although there are many types of cranes and hoists which have been designed to mount on pick-up trucks, there are problems and limitations common to most of these cranes.

Previous cranes were generally designed for vertical hoisting only, and usually only close to the rear of the truck. Extended reach, and the ability to move loads horizontally onto the truck has not been provided. In addition, the problem of installing and removing a truck mounted crane was left to the user to solve, and often required additional hoists, structures, or individuals to assist in the process. Also, no method of moving or storing the crane off the truck has been provided.

SUMMARY

This invention is comprised of a removable, truck mounted crane consisting of a steel base frame with a double A-frame reel structure supporting two booms. A horizontal, telescoping steel tube boom which extends the reach of the crane well beyond the rear of the truck. This boom can be secured at various degrees of extension by means of a quick release pin. A second inclined, rear mounted steel wishbone boom is used for high vertical lift at the rear of the truck, or for extra support of the extended telescoping boom when under high loads. The entire wishbone boom assembly is mounted to the crane with quick release pins allowing it to be dropped down or removed if required for height clearance. Both a manual and an electric winch are provided, which along with quick release pins on the various pulleys, allow for either winch cable to be routed to either boom. In addition, one winch may be used to retract the telescoping boom while under load.

This combination of two boom types, multiple pulleys, and two winches provides great flexibility in reach and hoisting height for both lifting and/or loading into the truck. All functions can be controlled by one operator while remaining clear of the load.

The crane is easily mounted or removed from the truck bed by one person by means of steel bolts through the bottom frame of the crane which secure into nuts welded to the truck, and a steel storage stand with castor wheels for maneuvering, and a steel angle lip which supports the truck tailgate and aligns it with the stand, while preventing movement between that and truck while removing or replacing the crane. Rollers on the stand allow the crane to be easily pulled on and off. A hand winch secured to the end of the stand opposite the truck end is used to pull the crane onto the stand. A hand winch mounted on a U-shaped steel bracket which drops into the front stake holes on the pick up truck bed is used to pull the crane from the stand onto the truck.

This system allow one person to install the crane in the bed of the truck, or to remove it and roll it to any storage location. When the crane is removed, there are no obstructions left in the truck bed to interfere with other uses.

DESCRIPTION OF THE PREFERRED EMBODIMENT

Figure 1:
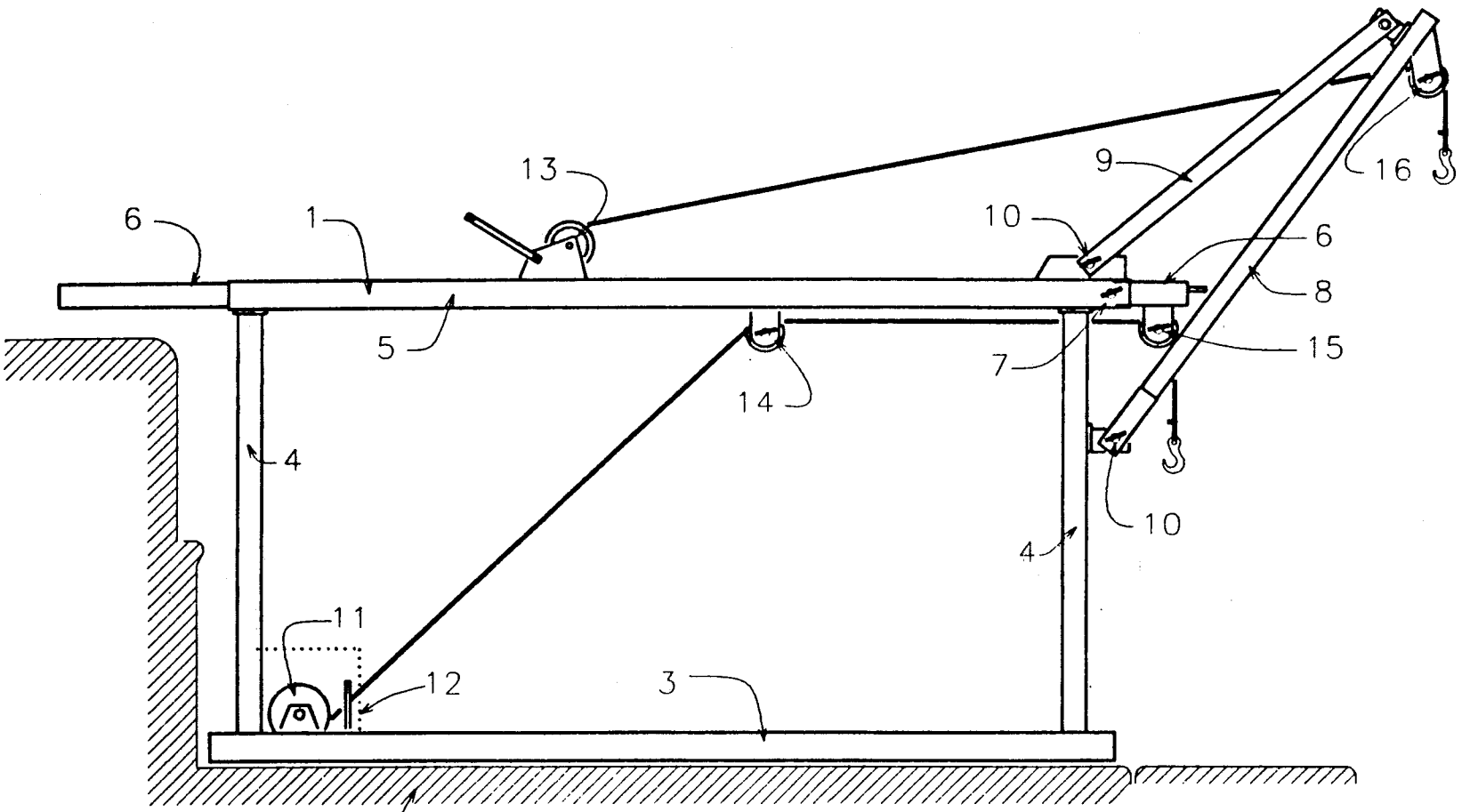
FIG. 1 is a side view of the crane, mounted on a truck, with the electric winch cable routed through the rear wish boom thereby prepared for close, heavy hoisting.
Figure 2:
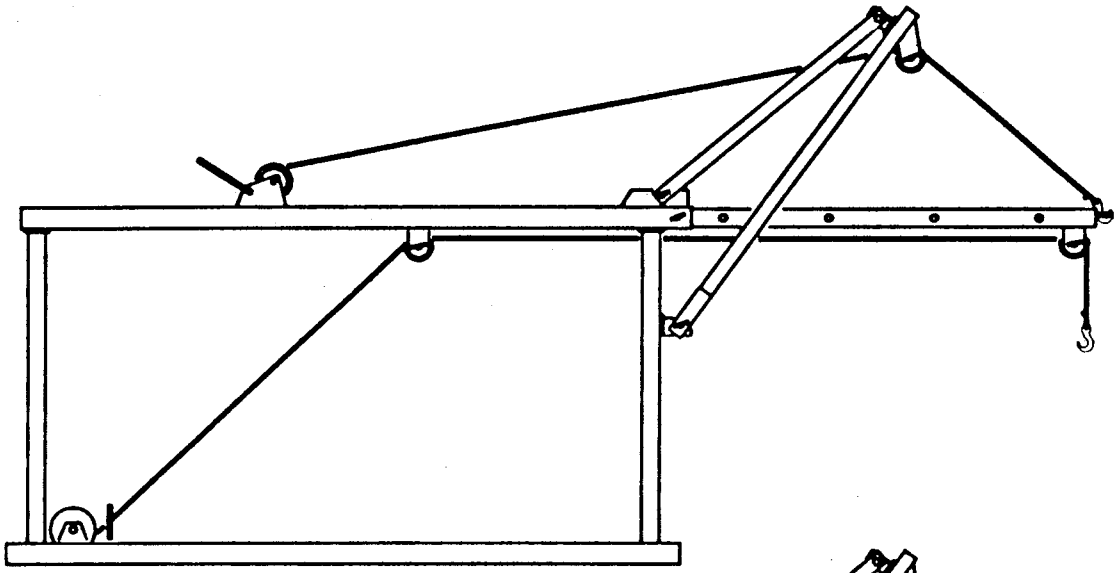
FIG. 2 is a side view of the crane, mounted on a truck, with the electric winch cable routed through the extended telescoping boom, and the hand winch cable routed through the wishboom to provide additional support to the extended boom.
Figure 3:
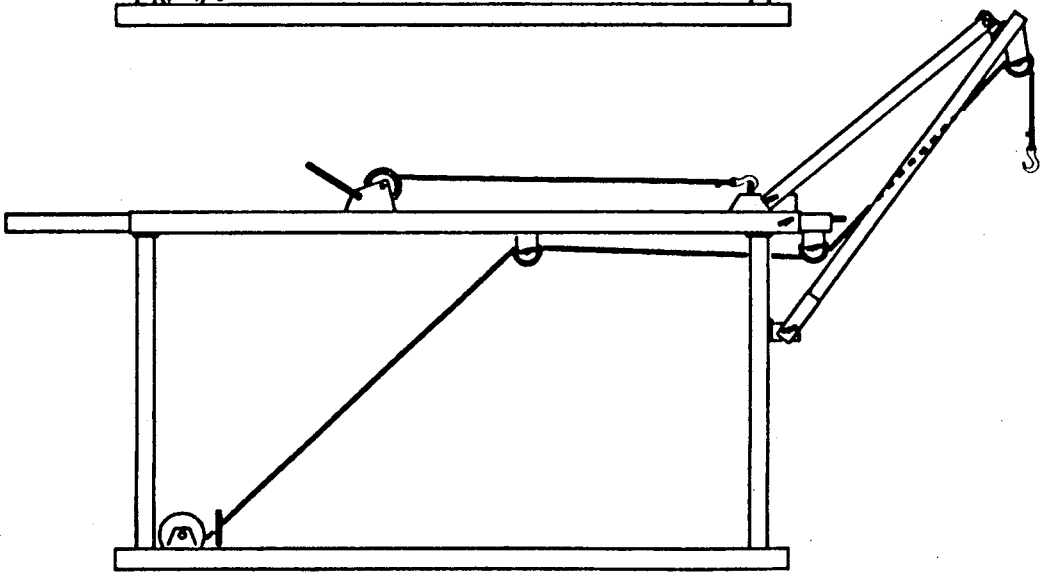
FIG. 3 is similar to FIG. 2 except the hand winch cable is used to retract the telescoping boom.
Figure 4:
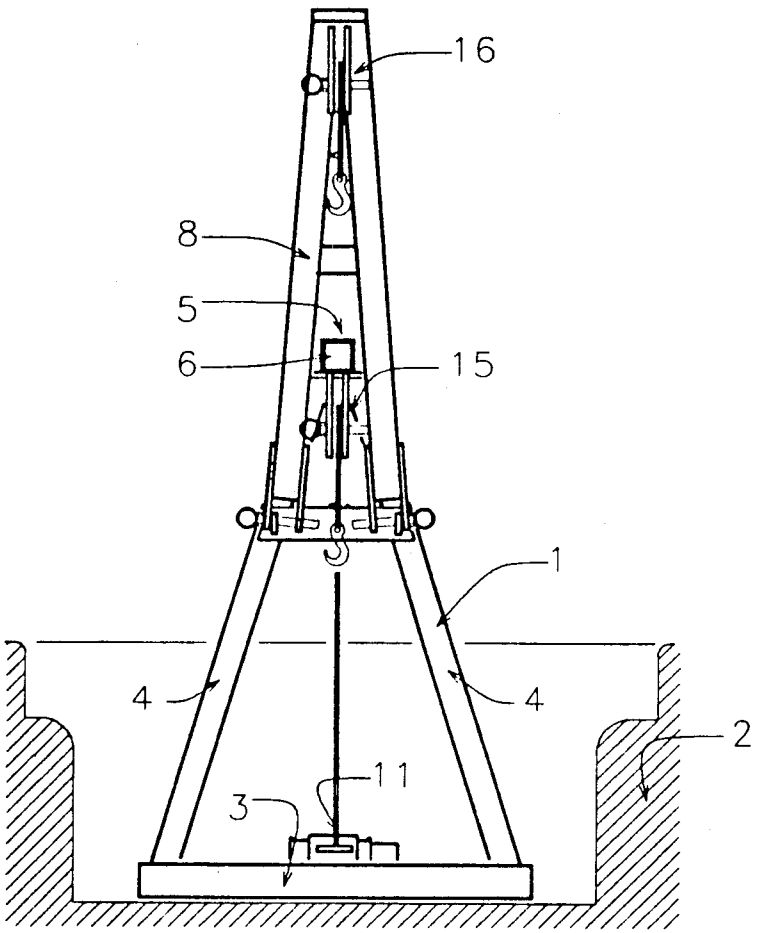
FIG. 4 is a view of the crane as seen from the rear of the truck.

Referring to FIGS. 1 and 4, there is illustrated a crane generally designated by the reference character 1 which is mounted onto the bed of a pick-up truck 2. The crane has a rectangular steel angle base frame 3 which is bolted to the truck bed, and supports a front and rear steel tube A-frames 4 which in turn support a horizontal steel tube 5. A smaller steel tube 6 slides inside tube 5 and form as an adjustable horizontal or telescoping boom. Boom 6 can be secured in various locations by means of a quick-release steel pin 7 which extends through holes in both tube 5 and 6. A second A-shaped steel tube wish boom 8 and steel support 9 is secured to the rear A-frame 4 with quick release pins 10, thereby allowing removal if necessary. An electric cable winch 11 is mounted to the forward transverse member of the steel angle base frame 3, and this winch is provided with a removable cover 12 (shown ghosted) for protection when needed. A manual cable winch 13 is attached to the horizontal tube 5. A cable pulley 14 is mounted to the underside of tube 5, and cable pulleys 15 and 16 are mounted to the ends of both the horizontal and wish boom. All cable pulleys are provided with quick-release pins allowing for the removal sheaves and thereby the re-routing of winch cables and the variety of hoisting configurations as shown in FIGS. 1, 2 and 3.

Figure 5:
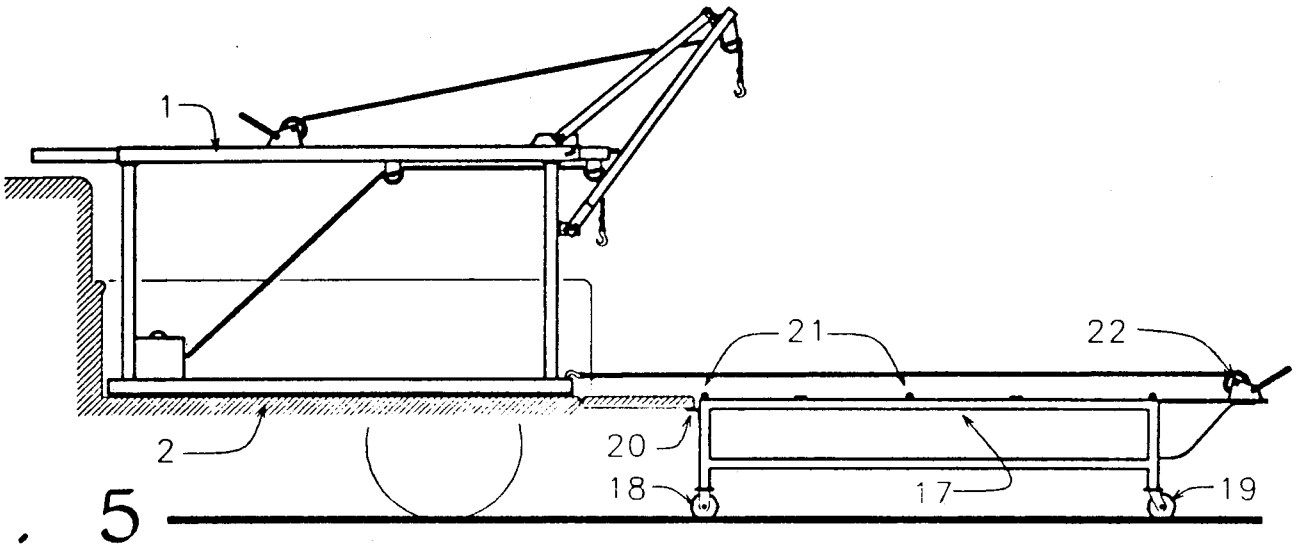
FIG. 5 is a view showing the rolling storage stand positioned to remove the crane from the truck bed.
Figure 6:
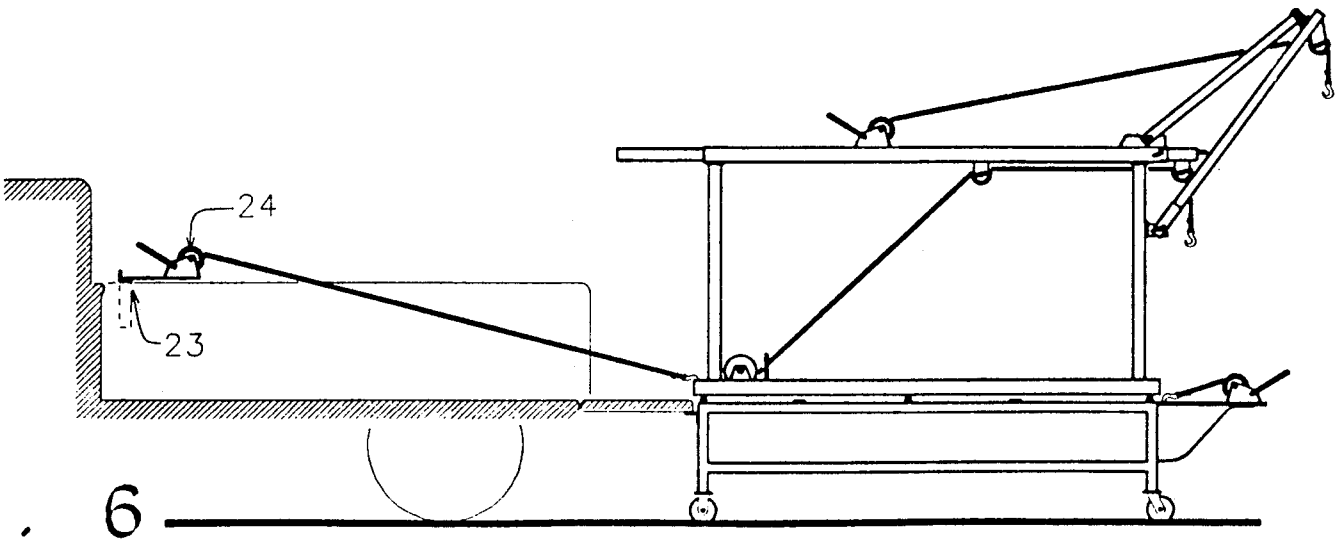
FIG. 6 is a view showing the rolling storage stand positioned to install the crane onto the truck.

Referring to FIGS. 5 and 6, there is illustrated a steel storage stand generally designated by the reference character 17 which is used to install and remove the crane 1 from the pick-up truck 2. This stand is mounted on fixed wheels 18 at the truck end, and pivoting wheels 19 at the opposite end thereby allowing easy alignment with the truck, and easy movement to a storage location. There is a steel angle 20 secured to the stand to support and align the truck tailgate with the stand, and full width rollers 21 to aid moving the crane on and off the stand. A Manual winch 22 is used to pull the crane from the truck onto the stand (see FIG. 5). As shown in FIG. 6, a U-shaped steel bracket 23 with a manual winch 24 mounted in the stakes holes on the truck bed to pull the crane from the stand onto the truck bed.

I claim:

1. A hoisting apparatus comprising:

(a) a steel base frame adapted to be bolted to a truck bed, attached to said frame are front and rear steel supports which support a horizontal steel tube above said truck bed;

(b) a first steel boom removeably secured to said frame and said horizontal tube as to extend upwardly inclined, rearwardly, and above said horizontal tube;

(c) a second steel boom mounted inside of said horizontal tube which is slidable therein to extend the distal end of said second boom to a position beyond the rear of said truck bed and means to secure the second boom in locked positions;

(d) a first pulley mounted on said distal end of said first boom and a second pulley mounted on the distal end of said second boom; and (e) a first winch mounted on said base frame and including a first winch cable, and a second winch mounted on said horizontal tube and including a second winch cable, whereby said first pulley accepts said first winch cable for lifting loads, and accepts said second winch cable for supporting and for retracting said second boom when said first winch cable is routed to said second pulley.

2. A hoisting apparatus according to claim 1 which further comprises a rolling storage stand with fixed and swiveling wheels, and includes a steel lip for supporting a tailgate of said truck bed, and winch means for pulling said base frame onto said stand.

* * * * *